United States Patent [19]

Bostick

[11] Patent Number: 4,928,594

[45] Date of Patent: May 29, 1990

[54] FOLDABLE RUBBER STAMP HANDLE

[76] Inventor: Charles R. Bostick, 833 W. 11th St., San Pedro, Calif. 90731

[21] Appl. No.: 339,258

[22] Filed: Apr. 17, 1989

[51] Int. Cl.[5] ..... B41K 1/56

[52] U.S. Cl. ..... 101/405

[58] Field of Search ..... 101/405, 406, 368

[56] References Cited

U.S. PATENT DOCUMENTS 3,315,601 4/1967 Borack ..... 101/368

4,395,948 8/1983 Monich ..... 101/405

*Primary Examiner*—Clifford D. Crowder

*Attorney, Agent, or Firm*—Roger A. Marrs

[57] ABSTRACT

A handle for supporting a graphic rubber stamp having a central base with a pair of end sections extending from each end of the base. The sections are provided with chamfered adjacent edges at 45 degree angles and a peelable tape backing joins the base and the respective pairs of sections together in an end-to-end relationship. A tacky adhesive is carried on the back of the base and sections and is exposed by removal of the tape backing. When removed, the sections are deployed or manipulated to be folded over upon themselves to provide an upright finger-gripping portion arranged normal to the base. A rubber stamp in the form of a graphic representation is adhesively carried on the base opposite to its side carrying finger-gripping portion.

4 Claims, 1 Drawing Sheet

FOLDABLE RUBBER STAMP HANDLE

BACKGROUND OF THE INVENTION

1. Field of the Invention

The present invention relates to the field of rubber stamps, and more particularly to a novel handle for a rubber stamp which is foldable from a flat planer position into an upright position ready for use.

2. Brief Description of the Prior Art

In the past, it has been the conventional practice to construct a rubber stamp from wood products or plastic molding wherein a block is provided to which an elongated handle is screwed or otherwise attached thereto. Next, a rubber alpha/numeric or graphic representation is adhesively attached to the block on its side opposite to the side carrying the handle. Although such handles for rubber stramps are suitable for use, such component parts are difficult to send through the postal services since they are bulky and therefore require boxes and added postage. Also, assembly is required when such a bulky rubber stramp is sent through the mail.

Furthermore, when such stamps are purchased in a stationery store or the like, the stamp is constructed from a block to which the handle is attached. This requires a substantial inventory of different sizes of blocks and handles to be carried by the merchant in order to accommodate customer needs.

Therefore, a long standing need has existed to provide a novel handle or support for graphic or alpha/numeric rubber stamps that may be readily shipped in a flat condition utilizing conventional envelopes and which do not require the expense of additional postage, such as when boxes and weighted component parts are being mailed. Preferably, such a novel stamp holder or handle should be flat in one position and foldable to a usable position when removed from the envelope. Furthermore, such a novel foldable stamp should be suitable for packaging in a kit form in a flat condition so that the kit may be sold as a unit to the customer directly.

SUMMARY OF THE INVENTION

Accordingly, the above problems and difficulties are obviated by the present invention which provides a novel foldable stamp which includes a handle having an initial planer position comprising a central base having a pair of sections hingeably carried on the opposite side of the base. Each pair of sections is hinged to each other and provided with an adhesive backing so that when folded over upon the central base, an upright finger-gripping portion is provided by combining the pair of sections. The adjacent edges of the sections in each pair include a 45 degree chamfer permitting the sections to be disposed normal to each other to complete the folding operation defining the finger-gripping portion. The hinges are defined by a double-backed adhesive tape and the assembly is complete by inclusion of an adhesively backed rubber stamp carrying alpha/numeric or graphic representations thereon. The rubber stamp is carried on the base opposite to its surface carrying the upright finger-gripping portion.

Therefore, it is among the primary objects of the present invention to provide a novel foldable rubber stamp and handle that may be converted or deployed from a flat position to an upright position so that the unassembled stamp may be sent through the mails in an ordinary envelope.

Another object of the present invention is to provide a novel rubber stamp construction having a first position which is planer and a second position whereby portions of the stamp are folded over upon themselves to define a finger-gripping portion.

Another object of the present invention is to provide a convertible rubber stamp adapted to be mailed in a flat position in an ordinary envelope or stored in an envelope as a kit for direct sales wherein the user may manipulate the components of the stamp into a base portion have a finger-gripping portion normal thereto projecting from one side and having an adhesively attached rubber stamp carried on the opposite side.

Still another object of the present invention is to provide an inexpensive foldable rubber stamp having its component portions in a disassembled condition which is flat and manageable through the mails or for distribution in an envelope kit and that may be readily removed from the envelope for deployment into a handled base carrying an adhesively attached rubber stamp.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
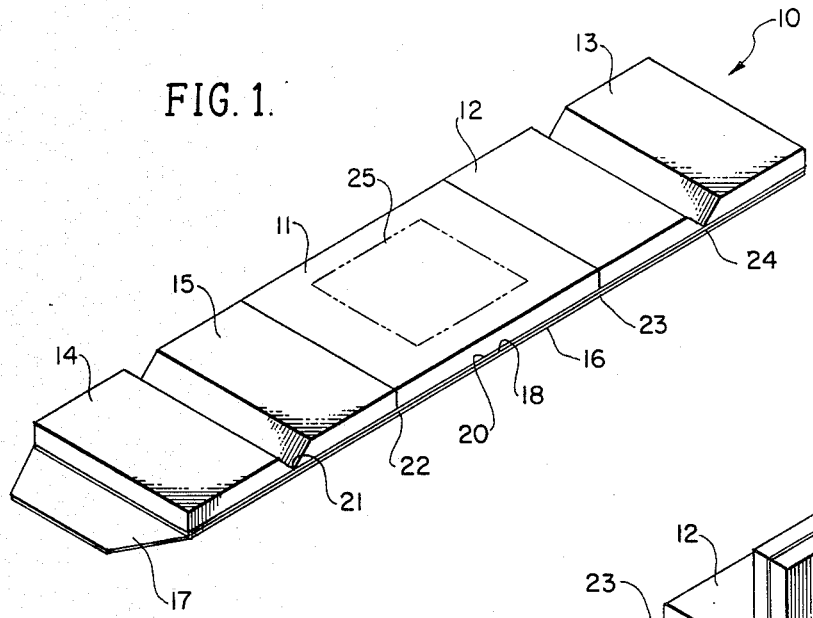
FIG. 1 is a perspective view showing the novel foldable stamp handle incorporating the present invention.

Referring to FIG. 1, the novel foldable holder for a rubber stamp is illustrated in the general direction of arrow 10 which includes an elongated member illustrated in its unfolded condition so that it is flat and suitable for insertion into an ordinary envelope or sales kit for distribution to the ultimate user. In this position, it is noted that the member is relatively thin and has a constant thickness throughout its length except for a pair of thickness reductions to be explained later. The member 10 includes an elongated base 11 which is centrally disposed with respect to two pairs of sections wherein each pair of sections is disposed adjacent to the respective opposite end of the central base 11. The first pair of sections is identified by numerals 12 and 13 while the second pair is identified by numerals 14 and 15. The respective pairs of sections are held together in an end-to-end relationship from the base 11 by means of a double-backed adhesive tape, indicated by numeral 16. Such a tape is conventional and comprises two outer sheets of plastic-like material which are separated by an adhesive material or substance. One of the sheets may be peeled from the tape to expose the adhesive when it is desired to attach the adhesive to other structure or elements. The backing tape 16 includes a tab 17 that outwardly projects from one end of the member 10 and the tab 17 is carried on the extreme end of the outer sheet of the backing tape 16. Therefore, when it is desired to expose the adhesive, the tab 17 is grasped and peeled to the other end of the member to expose the adhesive The adhesive is represented by the numeral 18 and the other sheet of the backing tape is indicated by numeral 20. The backing sheet 20 of the tape is secured to the surface of the member 10 so as to join the respective pairs of sections with the base 11.

Selected portions of the backing sheet 20 provide or constitute a hinge and these areas are represented by numerals 21, 22, 23 and 24 respectively.

Figure 4:
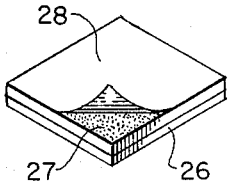
FIG. 4 is a perspective view showing the peelable double adhesive tape carried on the base of the stamp handle shown in FIG. 1.

It is to be particularly noted that the adjacent and opposing ends of the pair of sections 14 and 15, as well as the opposing adjacent ends of sections 12 and 13 are chamfered or angled at a 45 degree slope. Such construction will permit folding of the respective sections in each pair when it is desired to assemble the member or change to its stamp position. An area 25 is presented on the underside of the section or base 11 against which a contoured rubber stamp is adhesively placed. Such a stamp is shown in FIG. 4 and is indicated by numeral 26. Preferably, the rubber stamp includes an adhesive 27 so that when its backing sheet 28 has been removed, the adhesive 27 is exposed and the stamp 26 may be aligned with and placed onto the surface 25 of the base 11.

Figure 2:
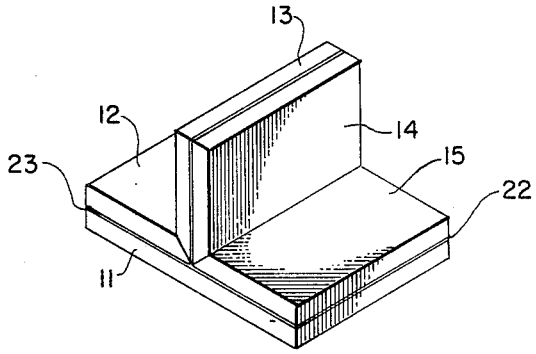
FIG. 2 is a front perspective view showing the stamp handle of FIG. 1 manipulated into a second or operable position.

Referring now in detail to FIG. 2, the foldable member 10 has been placed into its assembled or finalized position where it will serve as a holder for the stamp 26. In the operative position, the base 11 has an exposed surface 25 to which the rubber stamp 26 has been adhesively attached. The pairs of sections have been folded over upon themselves via hinges 22 and 23 so that they rest on the surface of base 11 opposite from the surface 25. The sections 13 and 14 of the respective pairs of sections are pivoted about their pivots or hinges 21 and 24 so that their adhesive backs face one another and are pressed together for securement. The sections 13 and 14 provide an upright finger-grasping portion which is normal or at a 90 degree relationship with respect to the base 11. Also, the surface of base 11 is adhesively coated so that it will secure with the adhesive carried on the sections 12 and 15.

Figure 3:
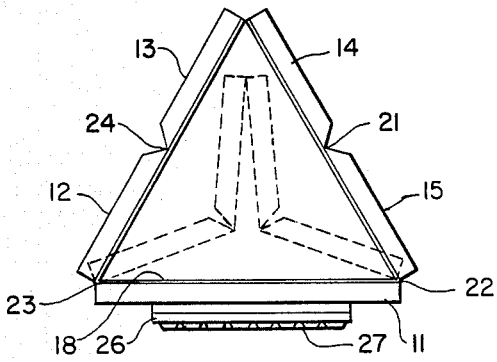
FIG. 3 is a side elevational view showing the stamp handle of FIG. 1 being deployed or manipulated into the final position shown in FIG. 2.

Referring now in detail to FIG. 3, an intermediate folding step is shown between the flattened article or member shown in FIG. 1 and the completed handle or holder shown in FIG. 2. After the backing sheet 17 has been removed so as to expose the adhesive layer 18, the pairs of sections are pivoted about the hinge points 22 and 23 so that the extreme ends of sections 13 and 14 may be registered together in alignment as shown. At this time, the pair of sections is depressed inwardly, as shown in broken lines, so that pivoting occurs about the pivots 21 and 24 respectively. This action will bring the respective adhesive on the opposing surfaces of the base and sections together for securement into the final handle configuration shown in FIG. 2.

Figure 5:
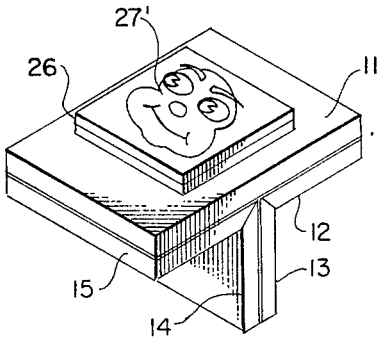
FIG. 5 is a perspective view of the underside of the base portion of the stamp handle showing the alpha/numeric or graphic representation carried thereon.

Referring now in detail to FIG. 5, a finalized or assembled construction is shown with the rubber stamp 26 illustrated in securement on the exposed surface of base 11. Sections 13 and 14 which are now secured together form the handle for finger-grasping by the user and the graphic representation of the rubber stamp is indicated by the numeral 27.

In view of the foregoing, it can be seen that the member 10 may be readily slipped into an envelope along with a rubber stamp 26, as shown in FIG. 4. The envelope may be sealed and placed in the postal system for distribution to an addressee. Upon removing the member 10 and rubber stamp 26 from the envelope, the user may now strip the outer backing sheet from the respective components so as to expose the adhesive and by manipulating the pair of sections, as shown in FIG. 3, the flat planer member 10 shown in FIG. 1 is manipulated into the completed handle, shown in FIGS. 2 and 5. The rubber stamp 26 may now be applied and secured to the exposed surface of base 11, as shown in FIG. 5, to complete the assembly.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A foldable stamp handle comprising:

a central base having opposite ends;

a pair of end sections extending from each end of said base to provide a linear arrangement with said central base established between opposite pairs of said end sections;

an operable fold line defined between adjacent ends of each end section of said pair of end sections and between said central base and each pair of each sections;

a peelable tape backing joining said central base and said opposite pairs of end sections together in end-to-end relationship;

an adhesive layer carried on said central base and pairs of end sections beneath said peelable tape backing adapted to be exposed for securing selected end sections together and other selected end sections to said central base when said end sections are folded about said fold lines whereby said selected end sections provide a handle suitable for finger grasping; and a rubber-like stamp carried on said central base on its side opposite from its side carrying said handle.

2. The invention as defined in claim 1 wherein:

said fold line is defined as a hinge provided by said backing and adhesive layer.

3. The invention as defined in claim 2 wherein:

each pair of said end sections having opposing edge marginal regions provided with chamfered edges permitting adjacent end sections to be folded into a 90° position to provide said handle normal to said central base.

4. The invention as defined in claim 3 including:

adhesive attachment means carried on said rubber-like stamp for affixation to said central base.

* * * * *